US009122240B2

(12) United States Patent
Hashimoto

(10) Patent No.: US 9,122,240 B2
(45) Date of Patent: Sep. 1, 2015

(54) IMAGE FORMING APPARATUS HAVING MECHANISM FOR ALLOWING PHOTOSENSITIVE DRUM AND DEVELOPING ROLLER TO CONTACT DURING INSERTION OF CARTRIDGE-MOUNTED DRAWER

(75) Inventor: Junichi Hashimoto, Toyohashi (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 484 days.

(21) Appl. No.: 13/421,064

(22) Filed: Mar. 15, 2012

(65) Prior Publication Data

US 2012/0269543 A1 Oct. 25, 2012

(30) Foreign Application Priority Data

Apr. 22, 2011 (JP) ..... 2011-096552

(51) Int. Cl.
*G03G 21/18* (2006.01)
*G03G 15/08* (2006.01)

(52) U.S. Cl.
CPC ..... *G03G 21/1853* (2013.01); *G03G 15/0836* (2013.01); *G03G 21/1821* (2013.01); *G03G 21/1825* (2013.01); *G03G 2221/1684* (2013.01);
(Continued)

(58) Field of Classification Search
CPC ..... G03G 21/1853; G03G 2221/1684; G03G 2221/1869; G03G 2221/1884; G03G 21/1821; G03G 21/1825; G03G 2221/1861; G03G 15/0836
USPC ..... 399/113
See application file for complete search history.

(56) References Cited

U.S. PATENT DOCUMENTS 7,860,433 B2 12/2010 Toba et al.
7,869,742 B2 1/2011 Igarashi et al.
(Continued)

FOREIGN PATENT DOCUMENTS

CN 1991622 A 7/2007
CN 1991624 A 7/2007
(Continued)

OTHER PUBLICATIONS

Notification of First Office Action issued in corresponding Chinese Patent Application No. 201210085449.3 issued Aug. 28, 2013.
(Continued)

*Primary Examiner* — David Gray
*Assistant Examiner* — Tyler Hardman
(74) *Attorney, Agent, or Firm* — Banner & Witcoff, Ltd.

(57) ABSTRACT

A cartridge has a first frame supporting a photosensitive member and a second frame supporting a developer carrying member. The first and second frames can take either a contact position where the two members are in contact with each other or a separated position where the two members are separated. A supporting member supporting the cartridge is movable between a mount position in a housing and a pull-out position outside the housing. When the supporting member is held in the pull-out position, the first and second frames are retrained in the separated position. The cartridge is supported on the supporting member to be movable between a first position where image formation is disabled and a second position where image formation is enabled. The cartridge is moved from the first position to the second position attendant to the movements of the supporting member from the pull-out position to the mount position.

11 Claims, 12 Drawing Sheets

(52) U.S. Cl.
CPC ..... *G03G 2221/1861* (2013.01); *G03G 2221/1869* (2013.01); *G03G 2221/1884* (2013.01)

(56) References Cited

U.S. PATENT DOCUMENTS

| | | | | |
|---|---|---|---|---|
| 7,885,574 | B2 | 2/2011 | Kamimura | |
| 8,086,139 | B2 | 12/2011 | Igarashi et al. | |
| 8,107,855 | B2 | 1/2012 | Nishimura et al. | |
| 8,175,492 | B2 | 5/2012 | Kamimura | |
| 8,213,831 | B2 | 7/2012 | Toba et al. | |
| 8,369,743 | B2 | 2/2013 | Maeshima et al. | |
| 8,396,393 | B2 | 3/2013 | Igarashi et al. | |
| 8,467,703 | B2 | 6/2013 | Nishimura et al. | |
| 2007/0147888 | A1 | 6/2007 | Igarashi et al. | |
| 2007/0147889 | A1 | 6/2007 | Kamimura | |
| 2007/0217818 | A1* | 9/2007 | Shiraki et al. | 399/111 |
| 2009/0003875 | A1 | 1/2009 | Toba et al. | |
| 2009/0003876 | A1* | 1/2009 | Maeshima et al. | 399/111 |
| 2009/0317133 | A1 | 12/2009 | Nishimura et al. | |
| 2010/0054797 | A1 | 3/2010 | Takeyama et al. | |
| 2011/0064459 | A1 | 3/2011 | Toba et al. | |
| 2011/0091242 | A1 | 4/2011 | Kamimura | |
| 2011/0097109 | A1 | 4/2011 | Igarashi et al. | |
| 2011/0164897 | A1* | 7/2011 | Kikuchi | 399/111 |
| 2012/0076536 | A1 | 3/2012 | Igarashi et al. | |
| 2012/0107015 | A1 | 5/2012 | Nishimura et al. | |
| 2012/0195636 | A1 | 8/2012 | Kamimura | |
| 2012/0201567 | A1 | 8/2012 | Toba et al. | |
| 2013/0108318 | A1 | 5/2013 | Maeshima et al. | |
| 2013/0188990 | A1 | 7/2013 | Igarashi et al. | |

FOREIGN PATENT DOCUMENTS

| | | | |
|---|---|---|---|
| CN | 101689035 | A | 3/2010 |
| CN | 101715570 | A | 5/2010 |
| EP | 1837713 | A1 | 9/2007 |
| JP | 05-232752 | | 9/1993 |
| JP | 2002-040905 | | 2/2002 |
| JP | 2006-171407 | | 6/2006 |
| JP | 2010-008511 | A | 1/2010 |
| WO | 2009/005159 | A1 | 1/2009 |
| WO | 2009/005163 | A1 | 1/2009 |

OTHER PUBLICATIONS

Dec. 1, 2014—(EP) Extended European Search Report—App 12159215.8.

* cited by examiner

IMAGE FORMING APPARATUS HAVING MECHANISM FOR ALLOWING PHOTOSENSITIVE DRUM AND DEVELOPING ROLLER TO CONTACT DURING INSERTION OF CARTRIDGE-MOUNTED DRAWER

CROSS REFERENCE TO RELATED APPLICATION

This application claims priority from Japanese Patent Application No. 2011-096552 filed Apr. 22, 2011. The entire content of the priority application is incorporated herein by reference.

TECHNICAL FIELD

The present invention relates to an electrophotographic image forming apparatus.

BACKGROUND

Electrophotographic printers have been known and used in various fields. Typically, such a printer accommodates a photosensitive drum and a developing roller. To print an image on a recording medium, an electrostatic latent image is formed on the photosensitive drum. The developing roller is held in pressure contact with the photosensitive drum to supply toner to the photosensitive drum and develop the electrostatic latent image with the toner. The toner image is transferred onto and thermally fixed on the recording medium.

When the printer of the typed described above is shipped while holding the developing roller in pressure contact with the photosensitive roller, the developing roller may be deformed during transportation or movement to the custody. When the printer with the deformed developing roller is used for printing by an end user, the printed image would be defective.

Japanese Patent Application Publication No. 2002-40905 discloses a mechanism for temporarily separating the developing roller from the photosensitive drum. In the printer disclosed in Japanese Patent Application Publication No. 2002-40905, a process cartridge is mounted in the printer body. The process cartridge includes a drum unit and a developing unit, in which both units are combined to form the process cartridge and normally held in an urged state. The outer wall of the drum unit is formed with a hole, and the outer wall of the developing unit with a dowel extending into the hole of the drum unit to engage therewith. The engagement of the dowel with the hole restricts the movements of the developing unit relative to the drum unit, and the developing roller can be held in spaced-apart from the photosensitive drum.

The dowel-hole engagement mechanism is configured to disengage the dowel from the hole when the process cartridge is mounted in the printer body. The process cartridge needs to be pushed into the printer body to mount it therein with stronger pushing force than force required to mount a process cartridge with no dowel-hole engagement mechanism. In other words, with the process cartridge having the dowel-hole engagement mechanism, additional force is needed to disengage the dowel from the hole. As the stronger pushing force is needed, it may be difficult for a certain user to mount the process cartridge in the printer body.

When the dowel-hole engagement mechanism disclosed in Japanese Patent Application Publication No. 2002-40905 is applied to a color printer having a plurality of process cartridges corresponding to a plurality of colors of toner, the user is imposed upon far more difficulty in mounting the plurality of process cartridges in the color printer body. The difficulty may invite such a problem that disengagement of the dowel from the hole is not accomplished during mounting of the process cartridges. If such a problem occurs, printing cannot be performed even if the process cartridges are believed to be properly mounted in the color printer.

SUMMARY

In view of the foregoing, it is an object of the invention to provide an image forming apparatus which facilitates mounting of a cartridge while minimizing damages of the components contained in the cartridge.

In order to attain the above and other objects, the invention provides an image forming apparatus having such a basic configuration as to include a housing, a cartridge, a supporting member, and a separation releasing mechanism. The cartridge has a first frame, a second frame, and a separation retaining member. The first frame is configured to support a photosensitive member. The second frame is configured to support a developer carrying member carrying developer thereon to supply the developer onto the photosensitive member. The first frame and the second frame are engaged so as to move relative to each other between a contact position where the developer carrying member and the photosensitive member are in contact with each other and a separated position where the developer carrying member and the photosensitive member are separated. The separation retaining member is configured to retain the first frame and the second frame in the separated position. The supporting member is configured to support the cartridge to be movable between a first position where image formation with the developer is disabled and a second position where image formation with the developer is enabled. The supporting member is movable between a mount position in the housing and a pull-out position outside the housing. The separation releasing mechanism is configured to move the cartridge from the first position to the second position and disable the separation retaining member attendant to movements of the supporting member from the pull-out position to the mount position.

BRIEF DESCRIPTION OF THE DRAWINGS

The particular features and advantages of the invention will become apparent from the following description taken in connection with the accompanying drawings, in which.

DETAILED DESCRIPTION

Figure 1:
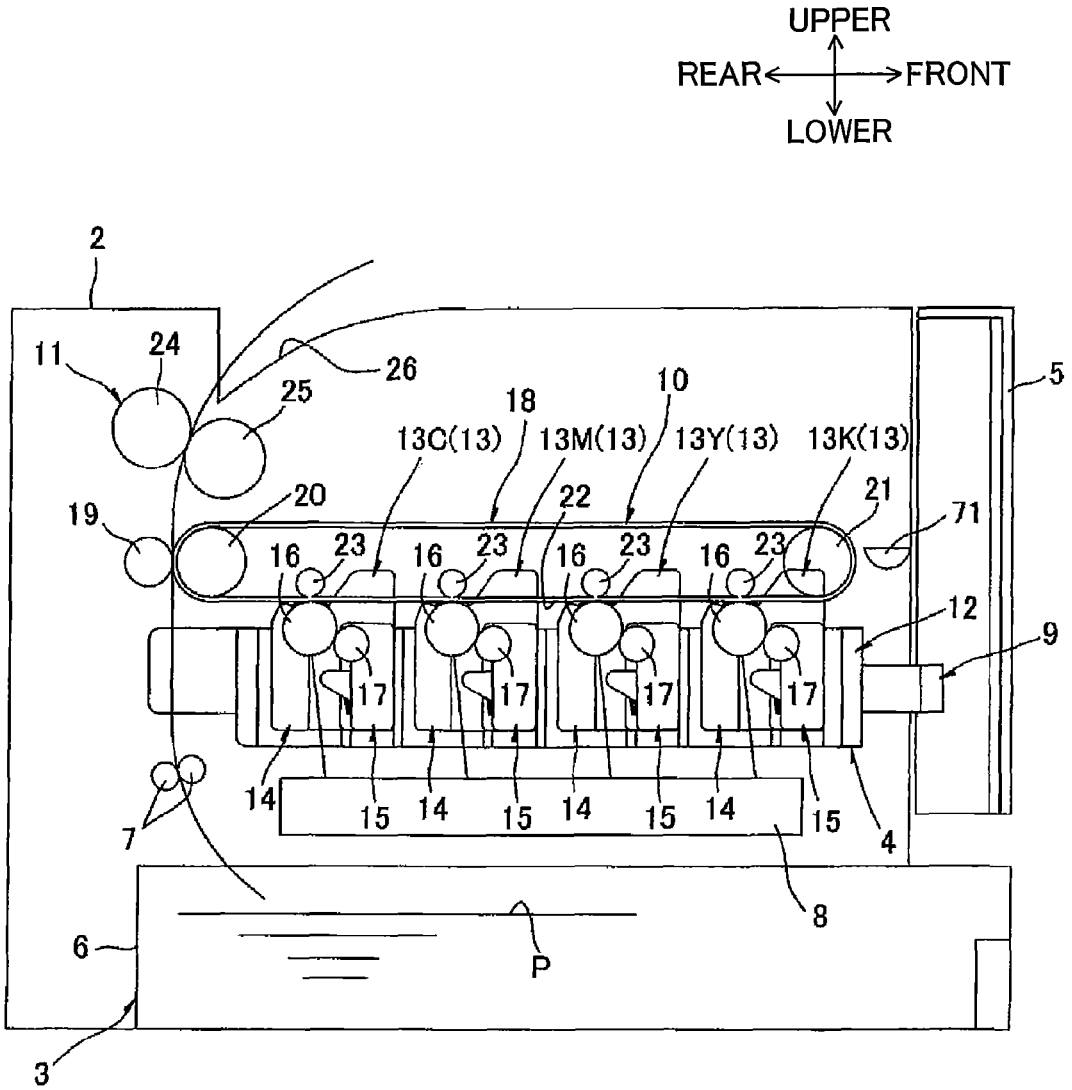
FIG. 1 is a vertical cross-sectional view showing a printer as one example of an image forming apparatus in accordance with the invention.

A color printer 1 shown in FIG. 1 is one example of an image forming apparatus of the invention. The color printer 1 is of an intermediate image transfer type in which a toner image is once transferred onto the intermediate image transfer belt and the image thereon is finally transferred onto a sheet of paper P. A sheet of paper P is one example of a recording medium on which the image is formed. Throughout the specification, the terms "upper", "lower", "right", "left", "front", "rear" and the like will be used assuming that the color printer 1 is disposed in an orientation in which it is intended to be used.

As shown in FIG. 1, the color printer 1 includes a housing 2 within which a sheet supplying section 3 and an image forming unit 4 are provided. The sheet supplying section 3 is provided for feeding a sheet of paper P toward the image forming unit 4 where images are formed on the sheet of paper P.

The housing 2 is substantially of a box-shape as viewed from right or left side. The image forming unit 4 is housed in the housing 2. A front cover 5 is provided in the front wall of the housing 2. Opening of the front cover 5 allows a drawer frame 12 (to be described later) to slidably move out of the housing 2.

It should be noted that the side in which the front cover is provided (right side in the drawing) is the front side of the color printer 1 whereas the opposite side (left side in the drawing) is the rear side of the color printer 1. The right side of the housing 1 as viewed from the front side is far side in FIG. 1 whereas the left side of the housing 1 as viewed from the front side 1 is near side in FIG. 1.

A pair of registration rollers 7 is disposed at a position above the rear end portion of the sheet feed tray 6. The topmost sheet of paper P stacked in the sheet tray 8 is fed toward the registration rollers 7. The registration rollers 7 feed the sheet of paper P at a prescribed timing into a nip between the image forming unit 4 (intermediate image transfer belt 22 to be described later) and a secondary image transfer roller 19 (to be described later).

The image forming unit 4 includes a scanner unit 8, a process unit 9, a transfer unit 10, and a fixing unit 11. The scanner unit 8 is disposed above the sheet tray 6. The scanner unit 8 irradiates laser beams onto photosensitive drums 16 as indicated by solid lines in FIG. 1 to expose the photosensitive drums 16 to light based on image data.

The process unit 9 is disposed on above the scanner unit 8 and includes the drawer frame 12 and four process cartridges 13. The drawer frame 12 is reciprocally movable in a direction from front to rear or rear to front (hereinafter referred to as "front-to-rear direction") between a mount position (see FIG. 1) in the housing 2 and a pull-out position (see FIG. 8) outside the housing 2. The drawer frame 12 can be drawn from the housing 2 to the pull-out position to facilitate replacement of the used process cartridge 13 with a new one. The process cartridges 13 are detachably mounted on the drawer frame 12 and arranged in parallel with one another with spacing between adjacent two process cartridges 13. The process cartridges 13 are arranged in the drawer frame 12 so that the longitudinal axis of each process cartridge 13 is orthogonal to the direction from the mount position to the pull-out position. In this embodiment, black process cartridge 13K, yellow process cartridge 13Y, magenta process cartridge 13M and cyan process cartridge 13C are arranged in the stated order in the drawer frame 12.

Each process cartridge 13 includes a drum unit (first frame) 14 and a developing unit (second frame) 15. The drum unit 14 is configured to rotatably support the photosensitive drum 16. The photosensitive drum 16 is substantially a cylindrical shape extending in the left-to-right direction and rotatably movably supported above the drum unit 14. The photosensitive drum 16 is exposed to light directed upward. The drum unit 14 includes a Scorotron charger (not shown) disposed in confrontation with the lower part of the photosensitive drum 16. The developing unit 15 is configured to rotatably support a developing roller (developing agent carrying member) 17. The developing roller 17 is rotatably supported at the rear side in the upper portion of the developing unit 15. The rear side of the developing roller 17 is exposed in the developing unit 15 in which toner of one of four colors is stored. The developing roller 17 is in contact with the front side of the photosensitive drum 16.

In operation, the toner stored in the developing unit 15 is carried on the surface of the developing roller 17 in accordance with rotations of the developing roller 17. On the other hand, the surface of the photosensitive drum 16 has been uniformed charged by the charger before reaching the position of the developing unit 15. After being charged, the photosensitive drum 16 is exposed to laser beam (see dotted line in FIG. 1) emitted from the scanner unit 8. The laser beam scans the surface of the photosensitive drum 16 at a high speed to form an electrostatic latent image corresponding to an image to be formed on a sheet of paper P.

In accordance with further rotations of the photosensitive drum 16, the toner carried on the surface of the developing roller 17 is supplied to the electrostatic latent image formed on the surface of the photosensitive drum 16. The electrostatic latent image is then visualized and a reversely developed toner image is carried on the surface of the photosensitive drum 16.

The image transfer unit 10 includes a belt unit 18 and the secondary image transfer roller 19. The belt unit 18 is disposed above the process unit 9 to confront the respective photosensitive drums 16. The belt unit 18 includes a drive roller 20, a follower roller 21, the intermediate image transfer belt 22, and four primary image transfer rollers 23. The drive roller 20 and the follower roller 21 are spaced apart in the front-to-rear direction to confront each other. The intermediate image transfer belt 22 is circularly movably wound onto the two spaced-apart rollers 20, 21 with taut. The intermediate image transfer belt 22 driven by the drive roller 20 has a lower part moving rearward and an upper part moving frontward. The photosensitive drums 16 are disposed to contact the lower part of the intermediate image transfer belt 22.

The primary image transfer roller 23 is rotatably disposed above the corresponding photosensitive drum 16 to be in confrontation therewith the lower part of the intermediate image transfer belt 22 interposed therebetween. The belt unit 18 per se is configured to be rotatably movable about a fulcrum positioned at the rear end of the belt unit 18. The belt unit 18 is movable in interlocking relation with the movements of the front cover 5. Specifically, the belt unit 18 is in a transfer position (see FIG. 1) when the front cover 5 is closed, in which the belt unit 18 is in contact with the photosensitive drums 16, whereas the belt unit 18 is moved to a retracted position (see FIG. 8) when the front cover 5 is opened, in which the belt unit 18 is separated from the photosensitive drums 16.

The secondary image transfer roller 19 is rotatably disposed at the rear side of the belt unit 18 to confront the drive roller 20 of the belt unit 18 with the intermediate image transfer belt 22 inter posed therebetween.

The toner images held on the respective photosensitive drums 16 are sequentially transferred onto the lower part of the intermediate image transfer belt 22 moving rearward, thereby forming a color image on the intermediate image transfer belt 22. The image transfer onto the intermediate image transfer belt 22 is referred to as a "primary image transfer". The color image on the intermediate image transfer belt 22 is transferred onto a sheet of paper P fed from the sheet supplying section 3 when the color image passes past the secondary image transfer roller 19. The image transfer by the secondary image transfer roller 19 is referred to as a "secondary image transfer" in contrast to the "primary image transfer".

The color image thus transferred onto the sheet of paper P is thermally fixed by a fixing unit 11. The fixing unit 11 includes a heat roller 24 and a pressure roller 25. The sheet of paper P with the color image thermally fixed thereon is discharged onto a discharge tray 26 formed on the upper surface of the housing 2.

Figure 2:
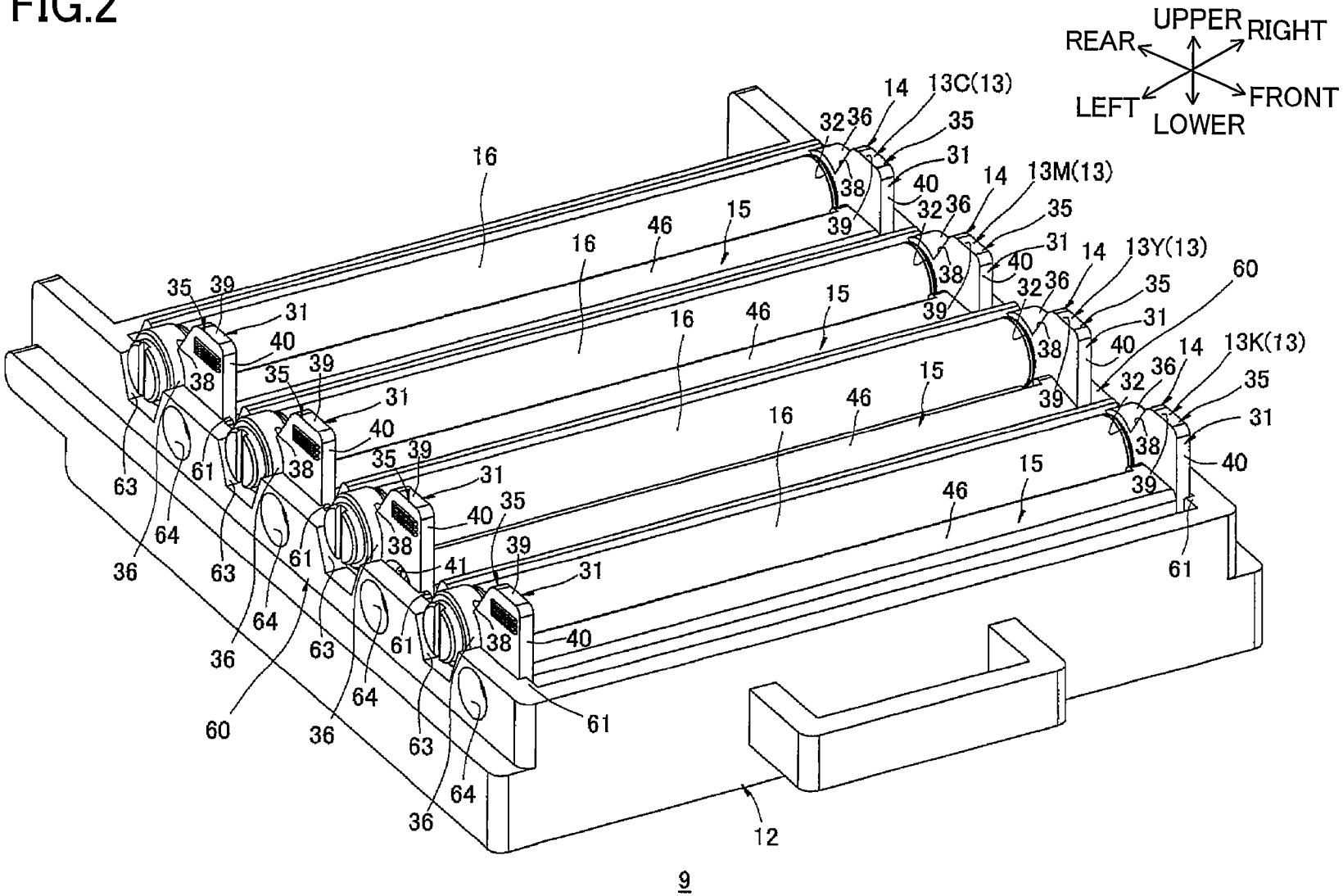
FIG. 2 is a perspective view, as viewed from left-front side, showing a process unit shown in FIG. 1.

As shown in FIGS. 2 and 3, the process unit 9 includes a plurality of process cartridges 13, and a drawer frame 12 for mounting the process cartridges 13 thereon. As shown in FIG. 2, in this embodiment, mounted on the drawer frame 12 are four process cartridges including black process cartridge 13K, yellow process cartridge 13Y, magenta process cartridge 13M and cyan process cartridge 13C. It should be noted that the process cartridges are generally denoted by reference numeral 13 but a specific color process cartridge is denoted by a combination of reference numeral 13 and an alphabetical letter designating a color of toner. To facilitate the following description, it is assumed that the yellow process cartridge 13Y is unused new one and the remaining three process cartridges are used ones but are still usable as the toner remains therein.

The process cartridge 13 is generally of a prism-shape and elongated in the left-to-right direction. Each process cartridge 13 includes the drum unit 14 and the developing unit 15. The drum unit 14 has a pair of supporting plates 31 provided at the left and right sides thereof for rotatably supporting the photosensitive drum 16. Beneath the photosensitive drum 16, a frame (not shown) is bridged between the pair of supporting plates 31 for supporting the charger. Each supporting plate 31 is generally rectangular as viewed from right or left side. The supporting plate 31 is formed with drum supporting portion 32, sleeve bearing 36, developing unit supporting hole 33, guide groove 34, projected portion 35 and stop portion 58 (see FIG. 5).

The drum supporting portion 32 formed in each of the pair of supporting plates 31 is a generally circular notched portion or a through-hole formed at the upper rear position thereof. The drum supporting portion 32 is formed for receiving the left and right ends of the photosensitive drum 16. The sleeve bearing 36 is generally of a cylindrical shape projecting outward from the supporting plate 31. The outer diameter of the sleeve bearing 36 is the same as the diameter of the drum supporting portion 32. The sleeve bearing 36 and the drum supporting portion 32 in each of the pair of supporting plates 31 rotatably support the left or right end portion of the photosensitive drum 16.

The developing unit supporting hole 33 is a circular through-hole formed at the central portion of the supporting plate 31. The developing unit supporting hole 33 receives the supporting boss 52 (to be described later) of the developing unit 15 to be rotatable therein. The guide groove 34 is formed linearly to extend upward from the lower center of the supporting plate 31. The guide groove 34 has a groove width in the front-to-rear direction capable of receiving a separation release rib 62 (to be described later) of the drawer frame 12.

An engagement hole 37 is formed at a position slightly higher than the center of the guide groove 34. The engagement hole 37 has an opening of a rectangular shape and penetrates the bottom wall 42 of the guide groove 34. As shown in 3A, the engagement hole 37 is provided for receiving the engaging projection 55 (to be described later) of the developing unit 15 when the drum unit 14 and the developing unit 15 are positionally separated (to be described later). In other words, the bottom wall 42 of the guide groove 34 functions as an engaging portion.

The projected portion 35 is a trapezoidal shape with the upper sider shorter than the lower side. Specifically, the front side of the projected portion 35 projects upward from the upper end of the supporting plate 31 further than the rear side of the projected portion 35. The upper surface 38 in the rear portion of the projected portion 35 is slanted diagonally upward toward the front side. The upper surface 38 of the rear portion and the upper surface 39 of the front portion both defining the projected portion 35 are continuous and extend in the front-to-rear direction.

Figure 3A:
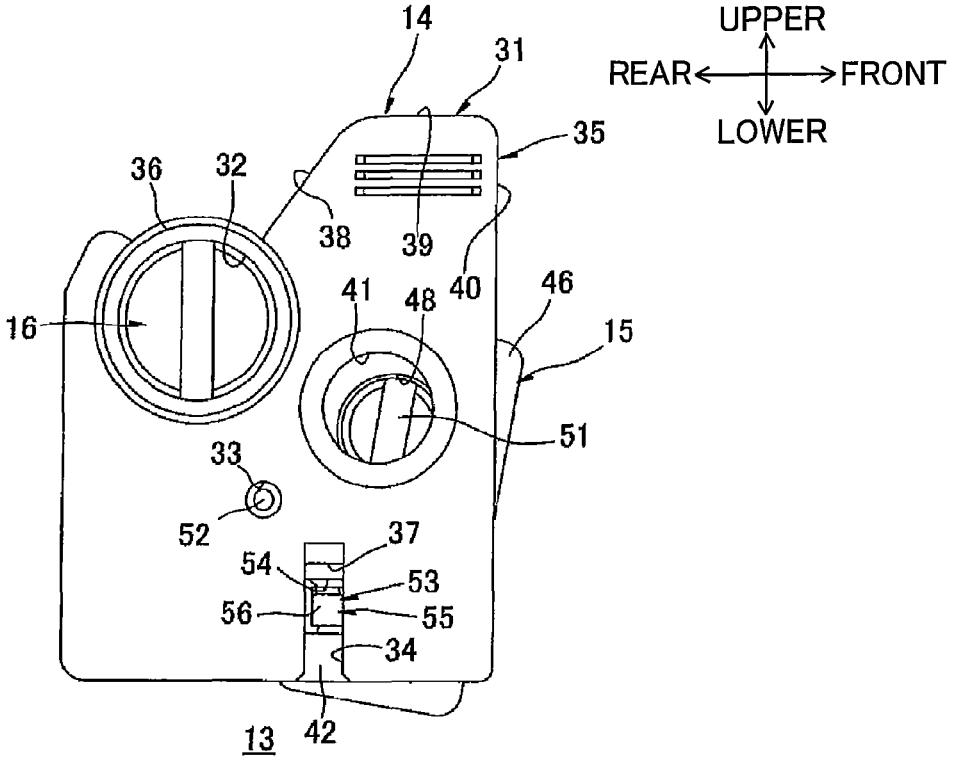
FIG. 3A is a left side view showing the process cartridge shown in FIG. 1, in which the drum unit and the developing unit are disposed in spaced apart.
Figure 3B:
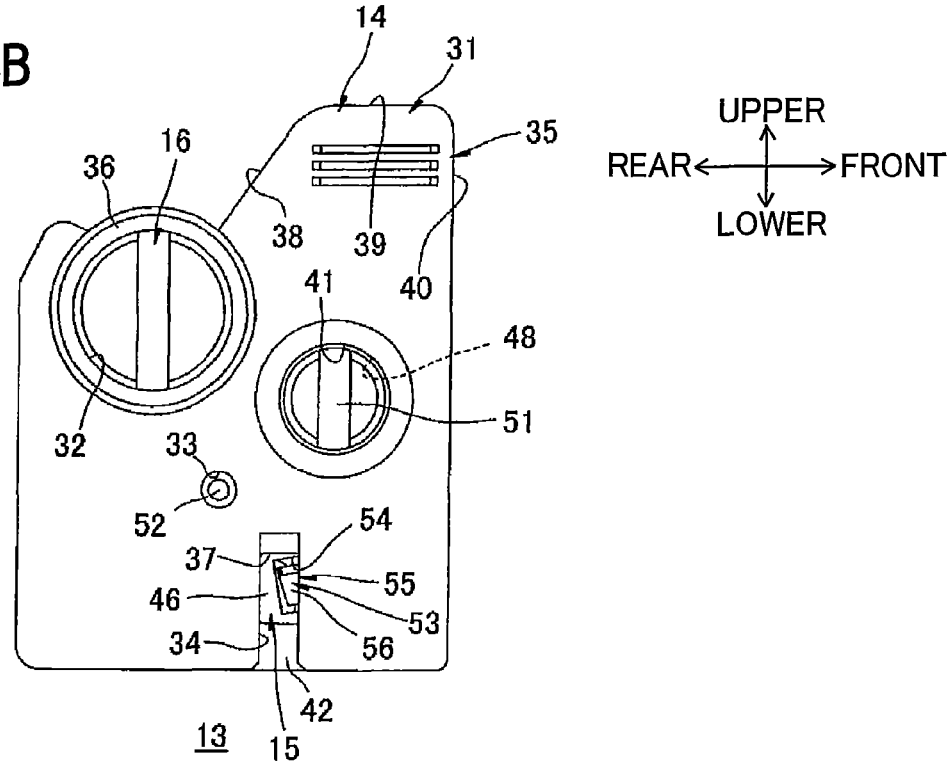
FIG. 3B is a left side view showing the process cartridge shown in FIG. 1, in which the drum unit and the developing unit are disposed in contact with each other.
Figure 5:
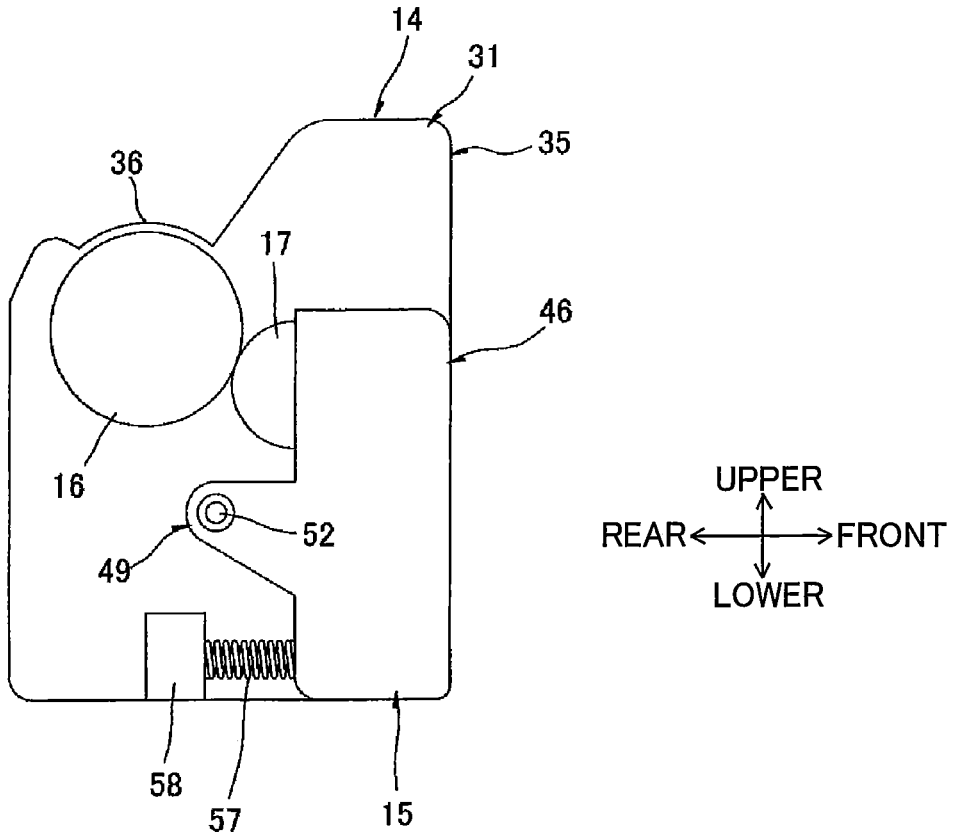
FIG. 5 is a side cross-sectional view showing the process cartridge shown in FIG. 1, in which the drum unit and the developing unit are disposed in contact with each other.

The stop portion 58 is in the form of a rectangular column extending in the left-to-right direction and disposed between the inner surfaces of the left and right side supporting plates 31 (see FIG. 5). The left side supporting plate 31 is formed with a coupling view window 41. The coupling view window 41 is formed in front of the drum supporting hole 32 and in the upper side of the guide groove 34. The coupling view window 41 is a circular hole with a diameter same as that of a development coupling support hole 48 (to be described later). The coupling view window 41 and the development coupling support hole 48 are brought into coincidence with each other when the drum unit 14 and the developing unit 15 are in a contact position where the two are in contact with each other (to be described later) as shown in FIG. 3B.

Figure 4A:
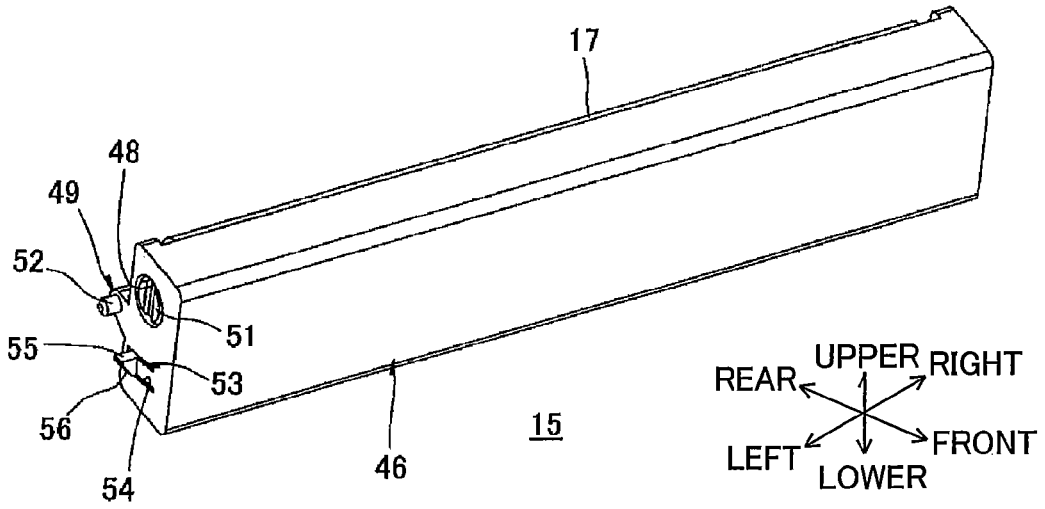
FIG. 4A is a perspective view showing the developing unit shown in FIG. 3, in which the drum unit and the developing unit are disposed in spaced apart.
Figure 6:
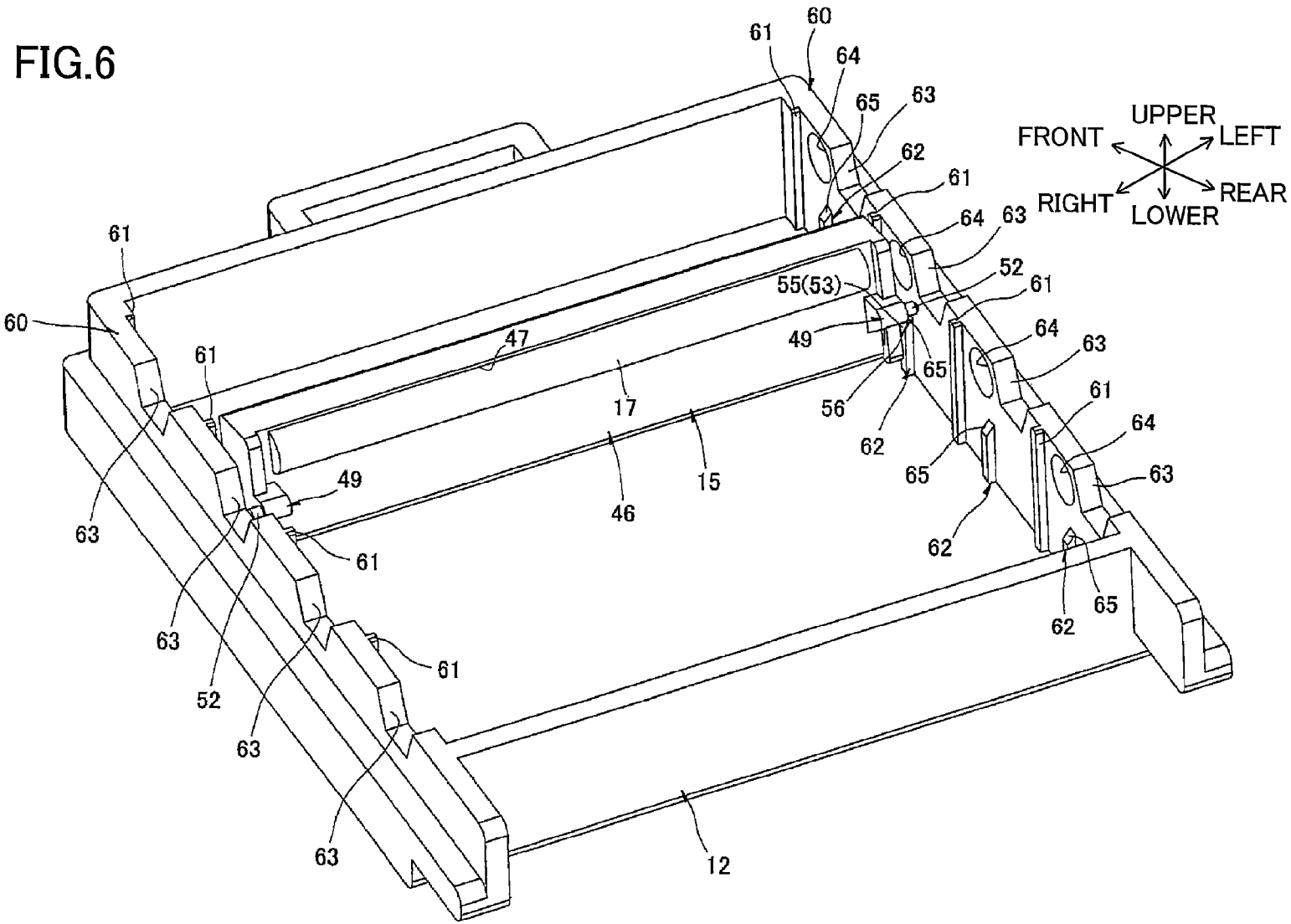
FIG. 6 is a perspective view, as viewed from right rear side, showing a drawer frame shown in FIG. 2.

As shown in FIG. 4, the developing unit 15 includes a development housing 46 made of a resin. The development housing 46 is an elongated box-shape extending in the left-to-right direction. As shown in FIG. 6, the development housing 46 is formed with a development opening 47. The development housing 46 includes left and right side support arms 49, left and right side engagement member accommodating grooves 54, and an engagement member 53 functioning as a separation member.

As best shown in FIG. 6, the development opening 47 is formed in the upper rear portion of the development housing 46 and open to rearward. The developing roller 17 is rotatably supported inside the development opening 47 so that the rear portion of the developing roller 17 is exposed. Each support arm 49 is generally in a convex shape having a protruded portion protruding rearward as viewed from the side. The support arm 49 is provided with a support boss 52. The support boss 52 is in the form of a round column extending outward from the support arm 49. The outer diameter of the support boss 52 is approximately equal to or slightly smaller than the diameter of the developing unit supporting hole 33.

The engagement member accommodating groove 54 is formed in the lower portion of each side wall of the development housing 46. The groove 54 is formed in the outer surface of the side wall to be recessed inward and extends in the front-to-rear direction. The outer profile of the groove 54 is seen to be a rectangular shape. The groove 54 has a depth (rightward depth for the left side wall and leftward depth for the right side wall) for absorbing resilient deformation (deflection) of the engagement member 53 deformed inward when the drum unit 14 and the developing unit 15 are in a contact position.

The engagement member 53 is a rectangular plate-shaped member disposed within the engagement member accommodating groove 54. The engagement member 53 extends rearward from the frontmost end of the groove 54. The engagement member 53 is made of resin and formed integral with the development housing 46. The engagement member 53 has a front end functioning as a fulcrum and a rear end or free end having resiliency to be deformable in the left-to-right direction. The direction in which the engagement member 53 extends is in coincidence with the left-to-right direction when the drum unit 14 and the developing unit 15 are separated. The engagement member 53 is formed with the engagement projection 55.

The engagement projection 55 is formed in the rearmost end of the engagement member 53 and has an apex projecting outward in the left-to-right direction. The engagement projection 55 is a triangular shape when viewed from front to rear. The engagement projection 55 has an upwardly slanted lower surface 56 functioning as a second slanted surface.

The development coupling support hole 48 is formed in the left side wall of the development housing 46. The support hole 48 is circular in rightward view and a development coupling 51 is rotatably engaged with the support hole 48. The development coupling 51 is a female member in the form of a rounded column. A coupling male member (not shown) of the housing 2 is fitted to the left end of the female member 51 so that the male member and the female member are not rotatable relative to each other. The development coupling 51 is operatively coupled via gear trains (not shown) to the developing roller 17 and other members to be rotatable.

The developing unit 15 is rotatably supported between the two supporting plates 31 of the drum unit 14. To support the developing unit 15, the support bosses 52 are inserted into the developing unit supporting holes 33 formed in the left and right supporting plates 31 of the drum unit 14.

Figure 4B:
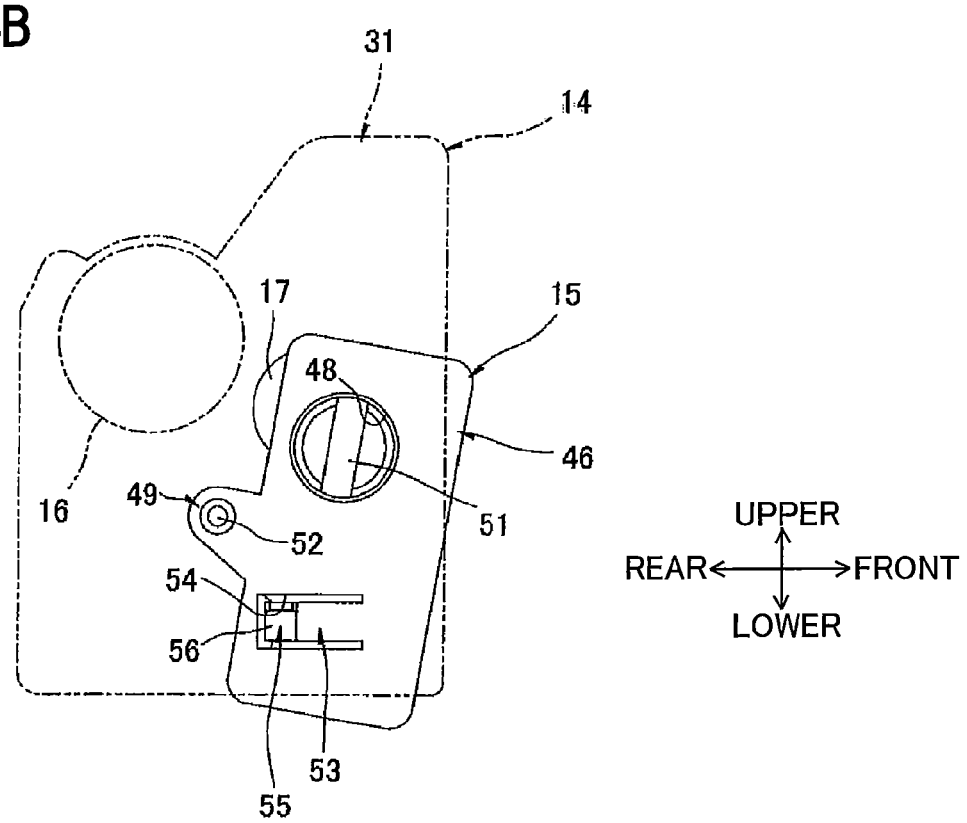
FIG. 4B is a perspective view showing the developing unit shown in FIG. 3, in which the drum unit and the developing unit are disposed in spaced apart.

As shown in FIG. 5, a compression spring 57 functioning as an urging member is disposed in the lower portion of the developing unit 15. The compression spring 57 has a front end secured to the rear surface in the lower part of the developing unit 15 and a rear end secured to the stop portion 58 of the drum unit 14. The compression spring 57 urges the developing unit 15 to rotate counterclockwise as viewed from the left side, so that the developing roller 17 is normally positioned closely to the photosensitive drum 16. At the time of shipment, the developing unit 15 is fixed between the left and right supporting plates 31 of the drum unit 14. Specifically, as shown in FIG. 3A, the engaging projections 55 are inserted into the engagement holes 37 of the drum unit 14, thereby holding the developing roller 17 in a position spaced apart from the photosensitive drum 16 at the front lower position thereof against the expansion force of the compression spring 57. That is, the drum unit 14 and the developing unit 15 are in a separated position as shown in FIG. 4B.

At this time, the front upper end portion of the development housing 46 projects frontward from the front end portion of the drum unit 14. Also, the front lower end portion of the development housing 46 projects downward from the lower end portion of the drum unit 14. When the engagement projection 55 of the developing unit 15 is compressed inward, the rear end portion of the engagement member 53 is resiliently deformed inward in the left-to-right direction. As a result, the engagement projection is retracted inward from the engagement hole 37 of the drum unit 14, thereby disengaging the engagement projection 55 from the engagement hold 37 of the drum unit 14. Then, by virtue of the expansion force of the compression spring 57, the developing unit 15 is rotated counterclockwise as view from the left side from the separated position. This brings the developing roller 17 into pressure contact with the photosensitive drum 16 and thus the drum unit 14 and the developing unit 15 are disposed in a contact position as shown in FIG. 5. At this time, the outer end portion of the engagement projection 55 is brought into abutment with the inner surface of the supporting plate 31 of the drum unit 14, thereby remaining the rear end portion of the engagement member 52 in an inwardly deformed condition. In other words, the supporting plates 31 of the drum unit 14 functions as a holding member.

When the drum unit 14 and the developing unit 15 are in the contact position, the front upper end portion of the development housing 46 is in flush with the front end portion of the drum unit 14, and the front lower end portion of the development housing 46 is in flush with the lower end portion of the drum unit 14.

As shown in FIG. 6, the drawer frame 12 is generally rectangular in plan view and is defined by a front wall, a rear wall, and a pair of side walls 60 disposed in spaced apart and in confronting relation with each other. Each side wall 60 is formed with four guide ribs 61 and four separation release ribs 62. Each side wall 60 is further formed with four drum supporting grooves 63. The guide ribs 61 in each side wall 60 are aligned in the front-to-rear direction with a predetermined interval between two adjacent guide ribs 61. The predetermined interval is equal to or slightly longer than the front-to-rear length of the supporting plate 31 of the process cartridge 13. The frontmost guide rib 61 is provided to be continuous to the rear side of the front wall of the drawer frame 12. The rearmost guide rib 61 is provided at a position in front of the rear wall of the drawer frame 12 with an interval equal to or slightly longer than the front-to-rear length of the supporting plate 31 of the process cartridge 13.

The guide ribs 61 are provided corresponding to the respective ones of the process cartridges 13 individually. The guide ribs 61 in each side wall 60 project inward and extend in vertical direction over the entire vertical width of the side wall 60.

The separation release ribs 62 are provided corresponding to the respective ones of the process cartridges 13 individually. Each separation release rib 62 projects inward and extends in vertical direction from the lower edge portion to the center of the side wall 60. The separation release ribs 62 are provided one by one between the rearmost guide rib 61 and the rear wall of the drawer frame 12 and between two adjacent guide ribs 61.

Each separation release rib 62 is formed with a position restricting surface (first slanted surface) 65. The upper slanted surface of the separation release rib 62 serves as the position restricting surface 65. The upper surface 65 of the separation release rib 62 is slanted to decrease its height toward the inner side.

The drum supporting grooves 63 are provided one by one at the rear side of the separation release ribs 62 between the rearmost guide rib 61 and the rear wall of the drawer frame 12 and between two adjacent guide ribs 61. The drum supporting groove 63 is of a concave shape as viewed from the left or right side and formed at the upper end face of the side wall 60. Specifically, the drum supporting groove 63 has inner tapered surfaces. The front-to-rear distance between the opposing inner tapered surfaces decreases as the groove 63 goes deeper level. The front-to-rear distance of the groove 63 at the upper end face is longer than the outer diameter of the sleeve bearing 36.

Figure 10:
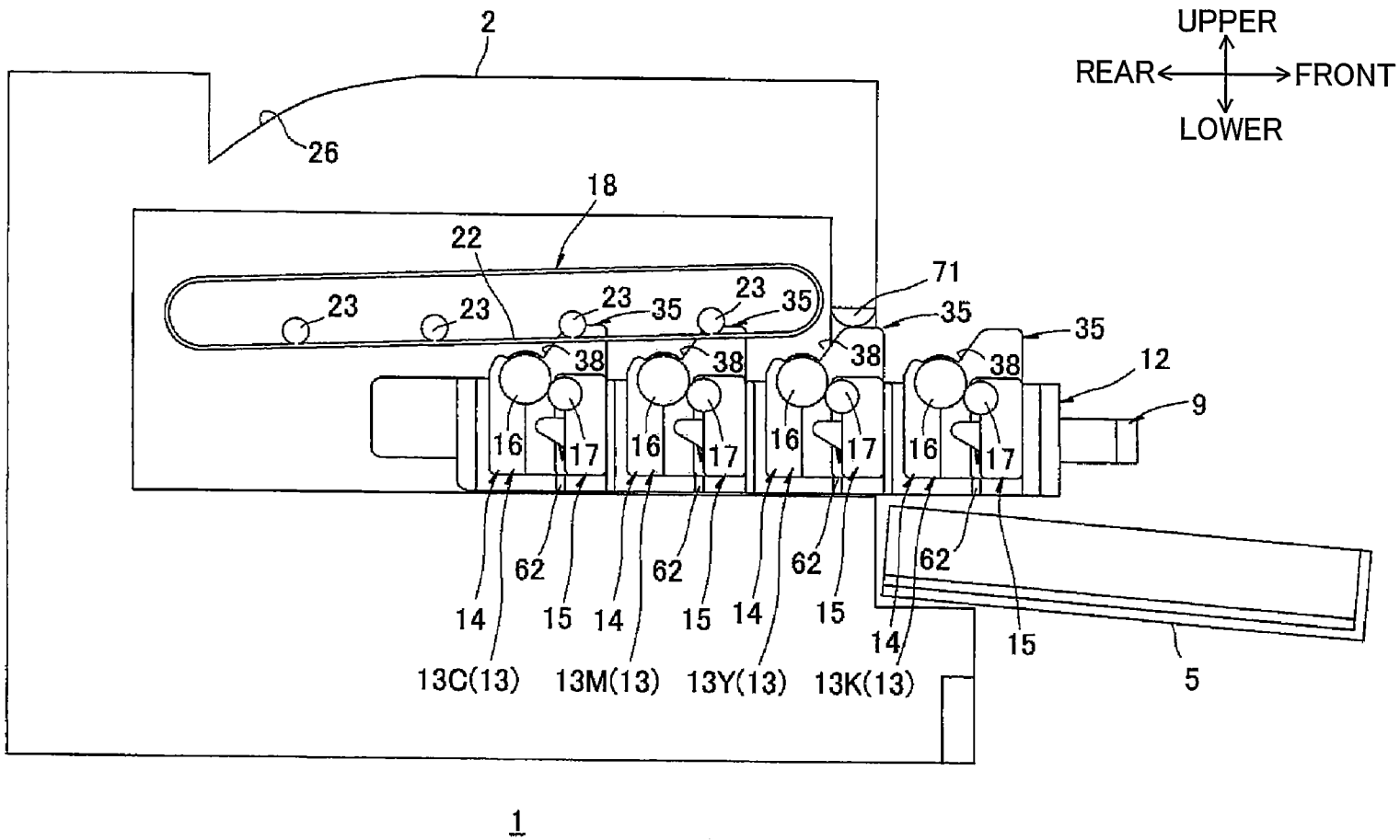
FIG. 10 is an explanatory diagram illustrating a third phase of the mounting operation of the process cartridge to be performed after the second phase, in which, in which the yellow process cartridge is disposed in a second position.

Four coupling view windows 64 are formed in the left side wall 60. The coupling windows 64 are formed one by one in the front side of the drum supporting grooves 63 and are circular having a diameter as large as that of the coupling view window 41 of the process cartridge 13. The coupling view window 64 is brought into coincidence with the coupling view window 41 of the process cartridge 13 when the process cartridge 13 is disposed in the second position (to be described later), as shown in FIG. 10.

At the time of shipping the color printer 1, the drawer frame 12 is separated from the housing 2. The process cartridges 13 are supported on the drawer frame 12 in such a state that the drum unit 14 and its associated developing unit 15 are separated. To support the process cartridges 13 on the drawer frame 12, the user has to grasp the process cartridge 13 while maintaining the rear side of the photosensitive drum 14 at the upper position, and then place the sleeve bearing 36 of the process cartridge 13 above the drum supporting groove 63 so that the associated guide groove 34 is positioned above the separation release rib 62 of the drawer frame 12.

Figure 7:
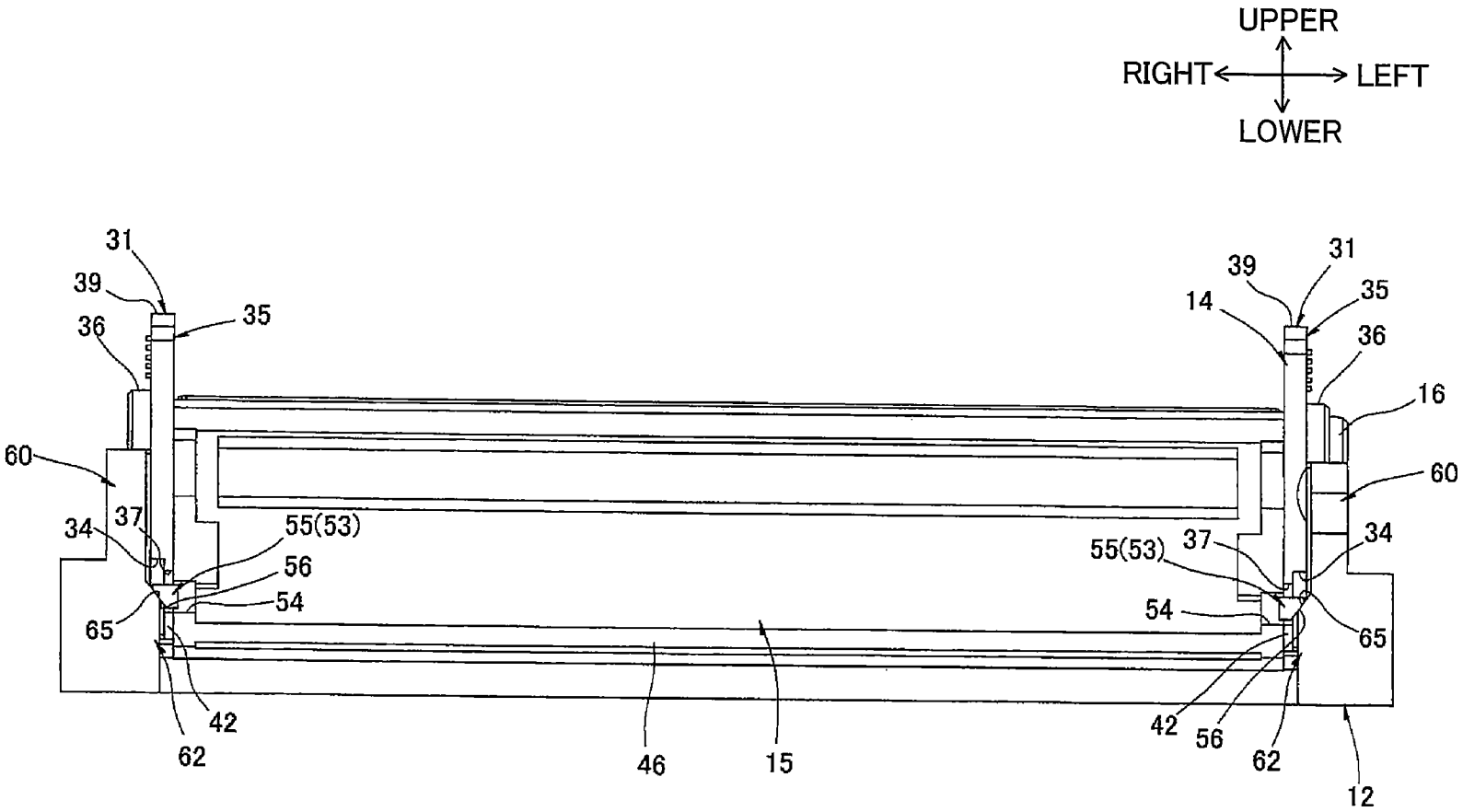
FIG. 7 is an explanatory diagram illustrating a state in which the process cartridge is supported on a first position.

Next, the process cartridge 13 is mounted on the drawer frame 12 from the upper side thereof. Then, the guide groove 34 of the drum unit 14 is brought into engagement with the separation release rib 62. As shown in FIG. 7, the lower surface 56 of the engaging projection 55 of the developing unit 15 is brought into abutment with the position restricting surface 65 of the separation release rib 62 of the drawer frame 12 from the upper side. That is, the guide groove 34 functions to guide the abutment of the separation release rib 62 and the engagement projection 55.

Due to the structure described above, the process cartridge 13 is prevented from being further inserted into the drawer frame 12, so that the process cartridge 13 is forced to be in the first position. This description applies to the yellow process cartridge 12Y shown in FIG. 8. That is, the upper portion of the separation release rib 62 functions as a position restricting portion.

At this time, the engagement projection 55 of the developing unit 15 is engaged with the engagement hole 37, thereby bringing the drum unit 14 and the developing unit 15 to be in a separated condition. As in the yellow process cartridge 13Y shown in FIG. 2, the sleeve bearing 36 of the process cartridge 13 is in confrontation with the lower wall of the drum supporting member 53 with an interval therebetween.

The engagement member 53 of the developing unit 15 is so rigid that it does not deform by the external force which may be applied thereto at the time of shipping.

Figure 8:
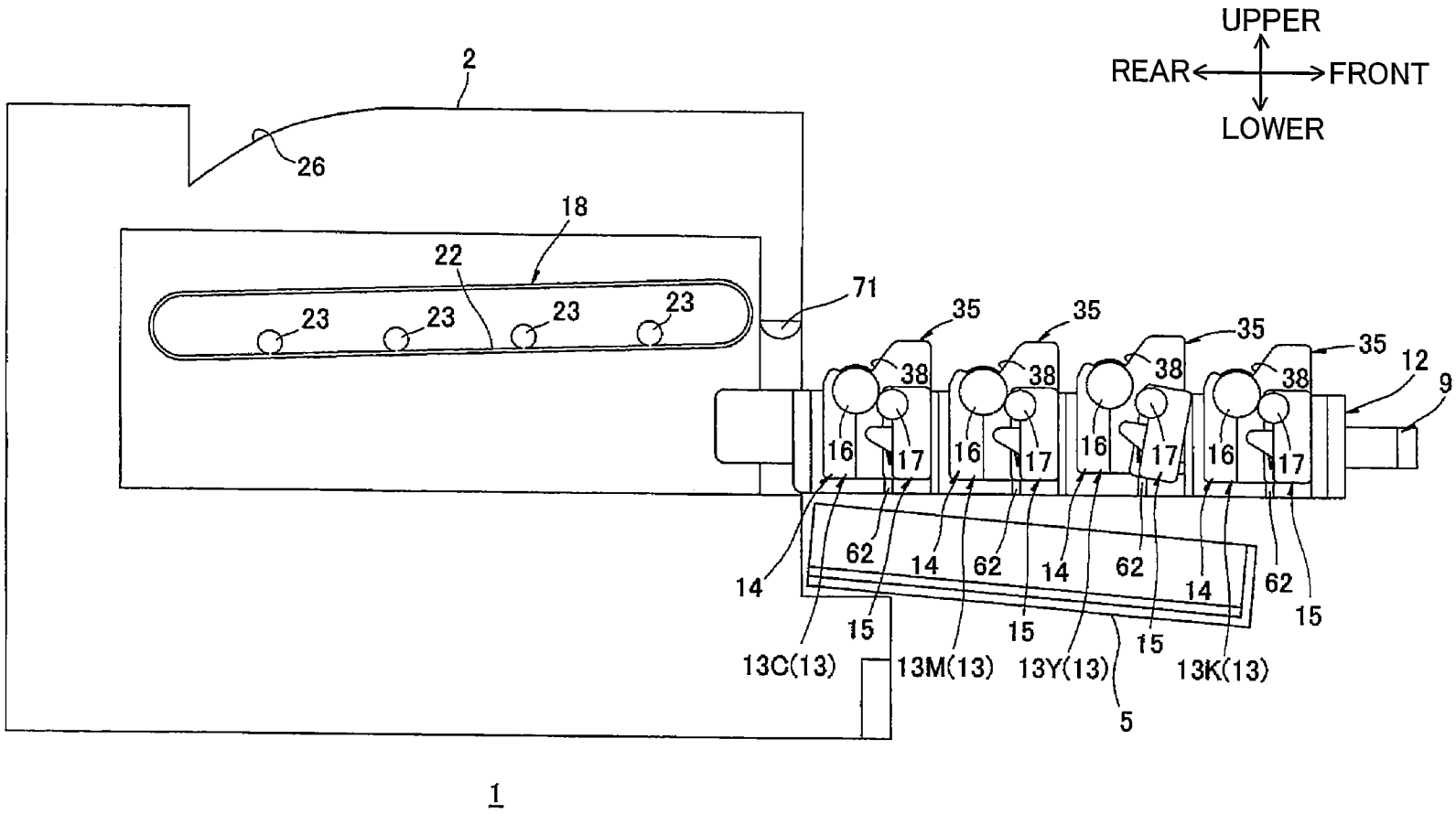
FIG. 8 is an explanatory diagram illustrating a first phase of a mounting operation of the process cartridge, in which the drawer frame is drawn to a pull-out position.

As shown in FIG. 8, the housing 2 is provided with a interfering member 71. The interfering member 71 is generally semi-circular shaped having a semicircular portion at the lower portion. The interfering member 71 is provided at the front end of the housing 2. Specifically, the interfering member 41 is disposed in the upper side of the cartridge mounting/removal path where the interfering member 41 is in abutment with the projected portion 35 of the process cartridge 13 disposed in the first position whereas the interfering member 41 is not in abutment with the process cartridge 13 disposed in the second position (to be described later with reference to FIG. 10). A separation release mechanism is configured by the interfering member 71 together with the separation release rib 62.

Next, mounting of the process cartridge 13 will be described. The following description pertains to a replacement procedure of the yellow process cartridge 13Y.

In order to place the yellow process cartridge 13Y in the housing 2, it is firstly necessary to open the front cover 5 as shown in FIG. 8. Then the process unit 9 is pulled out of the housing 2 and the used yellow process cartridge 13Y is removed upward from the drawer frame 12. A new yellow process cartridge 13Y is mounted on the drawer frame 12 to be stopped in first position, whereupon the drawer frame 12 is moved to the mount position.

Figure 9:
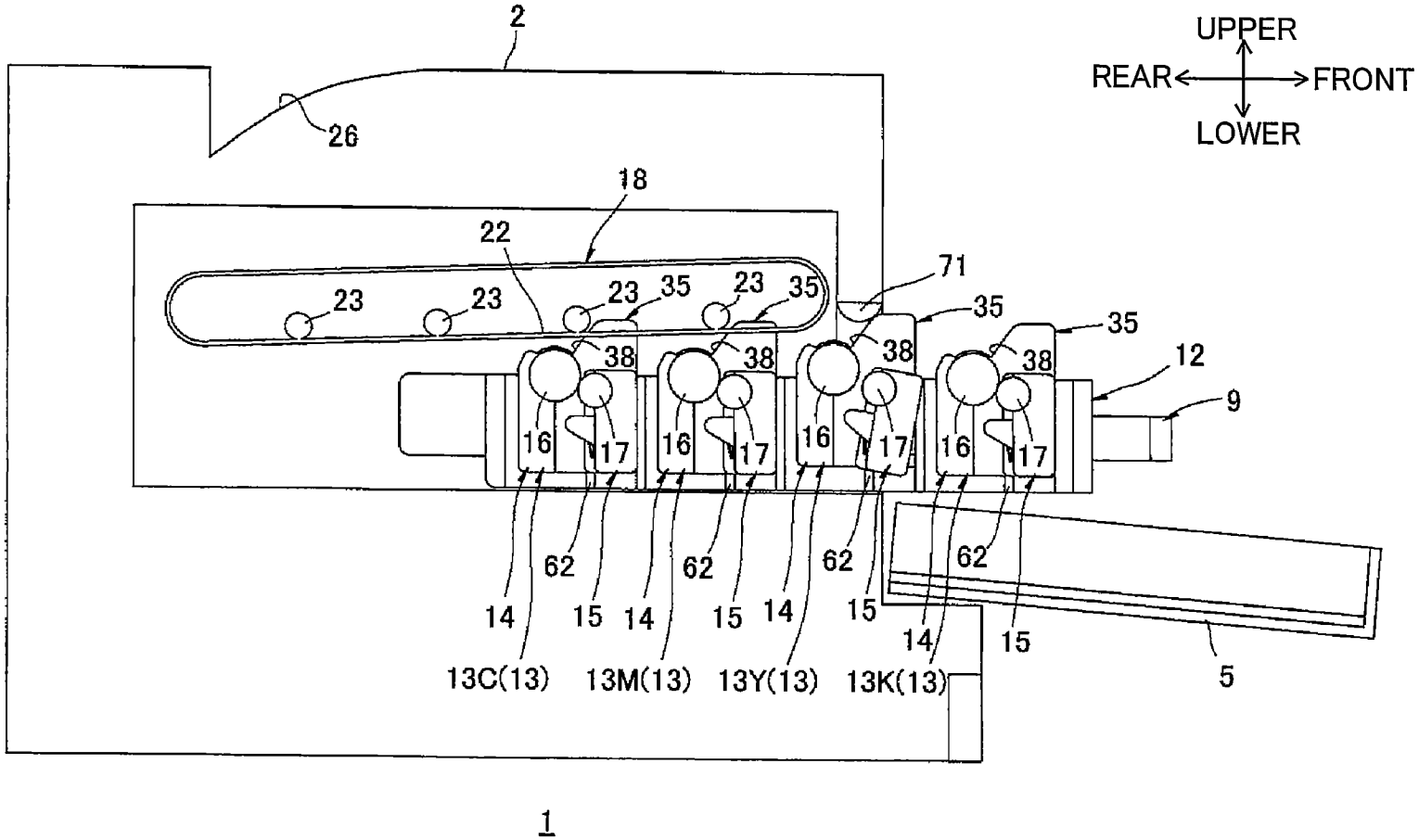
FIG. 9 is an explanatory diagram illustrating a second phase of the mounting operation of the process cartridge to be performed after the first phase, in which a yellow process cartridge is brought into abutment with a stop when the drawer unit is on its way to an mount position.

As shown in FIG. 9, the rear surface 38 of the projected portion 35 of the yellow process cartridge 13Y is brought into abutment with the interfering member 71 on the way to the mount position from the pull-out position. When the user further inserts the drawer frame 12 into the housing 2, the yellow process cartridge 13Y is urged downward by the interfering member 71 as the slanted rear surface of the projected portion 35 slides along the lower part of the circular section of the interfering member 71. The yellow process cartridge 13Y is moved downward and the lower surface 56 of the engaging projection of the developing unit 15 is inwardly urged by the position restricting surface 65 of the separation release rib 62. This causes the rear end of the engagement member 53 to resiliently deform inward in the left-to-right direction, so that the engagement projection 55 is disengaged from the engagement hole 37 of the drum unit 14. As a result, the developing unit 15 is rotated counterclockwise as viewed from the left side from the separated position by virtue of the expansion force of the compression spring 57.

The developing roller 17 is then brought into pressure contact with the photosensitive drum 16, thereby placing the drum unit 14 and the developing unit 15 in the contact state. In this state, the yellow process cartridge 13Y is available for forming images (see FIG. 5). At this time, when the engagement projection 55 is retracted inward from the engagement hole 37 of the drum unit 14, the lower surface 56 of the engagement projection 55 of the developing unit 15 is no longer in abutment with the position restricting surface 65 of the separation release rib 62 formed in the drawer frame 12.

Then, the yellow process cartridge 13Y is no longer restricted to the first position. As shown in FIG. 10, the yellow process cartridge 13Y is moved downward and the sleeve bearing 36 of the yellow process cartridge 13Y is brought into engagement with the drum support groove 63. The yellow process cartridge 13Y is thus held in the second position. (Refer to the process cartridges other than the yellow process cartridge 13Y shown in FIG. 2.) To summarize, the replaced process cartridges 13 are firstly placed in the first position before the drawer frame 12 is in the pull-out position and then placed in the second position upon completion of the cartridge mounting procedure and during movements of the drawer frame 12 toward the mount position.

Thereafter, the drawer frame 12 is accommodated in the mount position and the front cover 5 is closed. Then, the belt unit 18 is placed in the transfer position and the upper part of the belt unit 18 is brought into contact with the photosensitive drums 16. This completes mounting the yellow process cartridge 13Y on the housing 2.

A new, unused printer 1 is in such a condition that the process unit 9 is separated from the housing 2 or the process cartridges 13 are placed in the first position on the drawer frame 12. In this case, the process unit 9 is accommodated into the housing 2 while holding the process cartridges 13 in the first position. In accordance with the movements of the process unit 9 toward the mount position, each process cartridge 13 is sequentially brought into abutment with the interfering member 71 and moved from the first position to the second position. In this way, in all the process cartridges 13, the drum unit 14 and the developing unit 15 are brought to a contact state.

The printer 1 is operable either in a monochromatic printing mode for printing a monochromatic (black and white) images or a color printing mode for printing a full color images. In order to switch the color printing mode to the monochromatic printing mode, the photosensitive drums 16 of the color (yellow, magenta and cyan) process cartridges 13 and the associated developing rollers 17 are separated by a distance shorter than the distance between the photosensitive drum 16 and the developing roller 17 which are disposed in the above-described separated condition. That is, the developing unit 15 is rotated less than the rotating amount of the developing unit 15 in the separated condition. The engagement projection 55 is not engaged with the engagement hole 37 again at the time of switching between the monochromatic print mode and the color printing mode but is held under the condition in which the engagement projection 55 is disengaged from the engagement hole 37.

Next, operational advantages of the embodiment will be described.

(1) As shown in FIG. 3, the printer 1 uses a process cartridge 13 in which the engagement member 53 is provided for holding the drum unit 14 and the developing unit 15 in the separated position.

As shown in FIGS. 9 and 10, the drawer frame 12 movably supports the process cartridge 13 to be movable between the first position where image formation with toner (developer) is disabled and a second position where image formation with toner is enabled.

The separation release mechanism (interfering member 71 and the separation release rib 62) not only moves the process cartridge 13 from the first position to the second position attendant to the movement of the drawer frame 12 from the pull-out position to the mount position but also releases holding the drum unit 14 and the developing unit 15 in the separated position.

As such, at the time of transportation or storage in the course of shipping the printer 1, insofar as the drum unit 14 and the developing unit 15 are held in the separated position, deformation of the developing roller 17 may not occur.

Under a condition where the process cartridge 13 is placed in the first position, the drawer frame 12 is inserted into the housing 2 in order to place the printer 2 in a print ready condition. The movements of the drawer frame 12 from the pull-out position to the mount position can move the process cartridge 13 from the first position to the second position. Also, the drum unit 14 and the developing unit 15 are no longer held in the separated position.

The process cartridge 13 can be set to the second position where images can be formed and also the developing roller 17 can be brought into contact with the associated photosensitive drum 16 in linking relation with the insertion of the drawer frame 12 into the housing 2.

(2) In the printer 1, the separation release mechanism is provided with the interfering member 71 and the separation release rib 62. When the drawer frame 12 is moved from the pull-out position to the mount position, the process cartridge 13 restricted to the first position by the separation release rib 62 can be moved to the second position by virtue of the interfering member 71 provided at the side of the housing 2. At this time, holding the drum unit 14 and the developing unit 15 in the separated position by the engagement member 53 can be released by the separation release rib 62. As such, the drum unit 14 and the developing unit 15 are no longer restricted to be held in the separated position in interlocking relation with the insertion of the drawer frame 12 into the housing 2.

As shown in FIGS. 9 and 10, the printer 1 has the drawer frame 12 on which the process cartridges 13 are detachably mounted. The process cartridge 13 is vertically moved for mounting on the drawer frame 12 along a direction from the first position of the process cartridge 13 to the second position thereof. Thus, easy mounting of the process cartridges 13 onto the drawer frame 12 can be achieved.

As shown in FIG. 3, the engagement hole 37 for engaging the engagement member 53 therewith is formed in the bottom wall 42 of the guide groove 34 formed in the drum unit 14. By such a simple structure, the developing roller 17 can remain separated from the photosensitive drum 16.

As shown in FIG. 7, the separation release rib 62 projects inward in the left-to-right direction from the side wall 60 of the drawer frame 12 and extends vertically. Further, the engagement member 53 is provided in the outside end portion in the left-to-right direction of the process cartridge 13. With such a simple structure, the separation release rib 62 can be brought into abutment with the engagement member 53.

As shown in FIGS. 6 and 7, the position restricting surface 65 is formed in the upper end portion of the separation release rib 62. The position restricting surface 65 restricts the process cartridge 13 to be in the first position by the abutment with the engagement member 53. As such, with the use of the upper end portion of the separation release rib 62, the process cartridge 13 can be restricted to the first position. Accordingly, without increasing the number of parts, yet with a simple structure, restricting the process cartridge 13 to the first position and also disengagement of the engagement member 53 from the engagement hole 37 can be accomplished.

As shown in FIG. 7, the position restricting surface 65 which is a slanted surface facing upward is formed in the upper end portion of the separation release rib 62, and the lower surface 56 of the engagement projection 65 formed in the engagement member 53 is brought into abutment with the position restricting surface 65. As such, when the process cartridge 13 is moved from the first position to the second position, the engagement projection 55 can be smoothly urged inward due to the slanted position restricting surface 65. In other words, moving the process cartridge 13 from the first position to the second position enables smooth disengagement of the engagement member 53 from the engagement hole 37.

As shown in FIG. 3, the engagement hole 37 is formed within the vertically elongated guide groove 34. Further, the engagement projection 55 is engaged with the engagement hole 37 within the guide groove 34. The separation release rib 62 is guided relative to the engagement projection 55 while being engaged with the guide groove 34. Accordingly, by utilizing the guide groove 34, the separation release rib 62 can be guided relative to the engagement projection 55 when the process cartridge 13 is placed in the first position. Additional guide member for guiding the separation release rib 62 relative to the engagement projection 64 is not required. Abutment of the separation release rib 62 with the engagement projection 55 can be ensured with such a simple structure.

The engagement member 53 is made of a resilient material. Against the resiliency of the engagement member 53, the separation release rib 62 resiliently deforms the engagement member 53, thereby causing the engagement projection 55 to move inward in the left-to-right direction. Accordingly, the resiliency of the engagement member 53 allows the engagement member 52 to be kept engaged with the engagement hole 37, and resilient deformation of the engagement member 53 easily disengages the engagement member 55 from the engagement hole 37.

As shown in FIG. 5, the process cartridge 13 used in the printer 1 is provided with the compression spring 57 for urging the developing unit 15 against the drum unit 14 so as to bring the developing roller 17 into contact with the photosensitive drum 16. When the engagement projection 55 is disengaged from the engagement hole 37, the developing roller 17 can be brought into contact with the photosensitive drum 16 due to the expansion force of the compression spring 57.

As shown in FIG. 3B, the supporting plate 31 of the process cartridge 13 holds the engagement member 53 in a position to no longer keep the drum unit 14 and the developing unit 15 in the separation position once the process cartridge 13 is moved to the second position. Accordingly, once the process cartridge 13 is moved to the second position, the developing roller 17 can be constantly held in a state to contact the photosensitive drum 16.

Figure 11A:
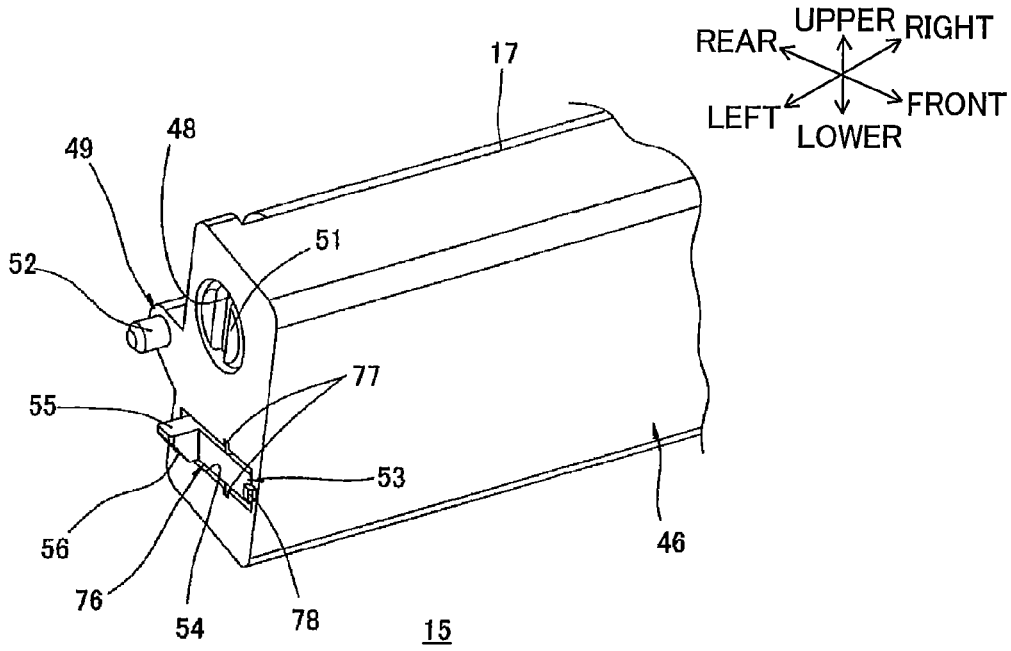
FIG. 11A a perspective view, as viewed from left-front side, showing the developing unit in accordance with a first modification of the embodiment, in which the drum unit and the developing unit are disposed in spaced apart.
Figure 11B:
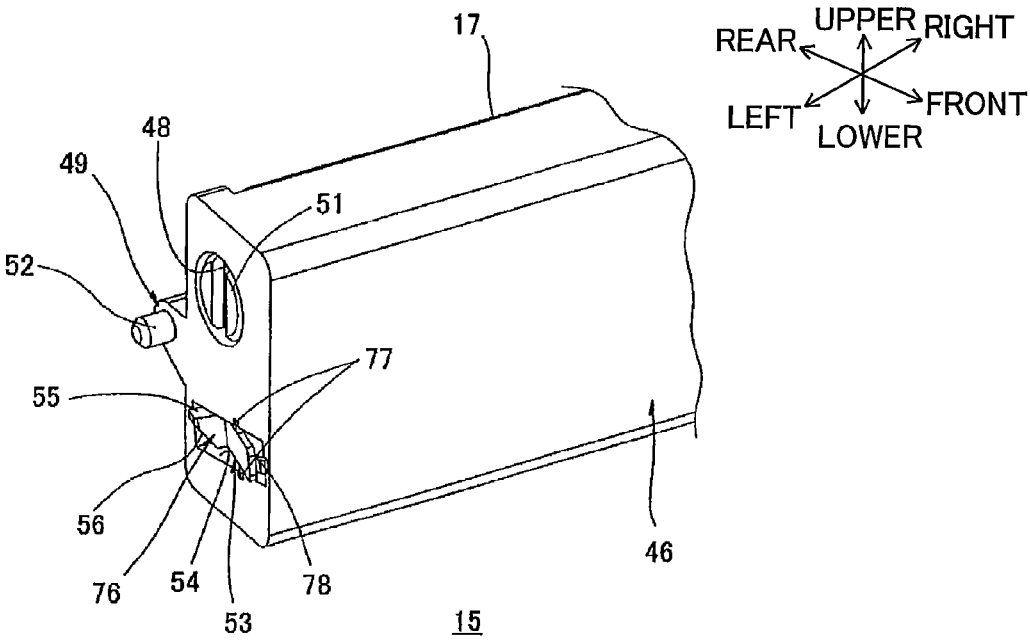
FIG. 11B is a perspective view, as viewed from left-front side, showing the developing unit shown in FIG. 3, in which the drum unit and the developing unit are disposed in contact with each other.

As shown in FIG. 11, the process cartridges 13 are arranged in the front-to-rear direction with spacing between the adjacent two. The developing roller 17 can be brought into contact with the photosensitive drum 16 when the process cartridges 13 are mounted on the housing 2 of the drawer frame 12 and the latter is moved to the image formable second position.

As shown in FIGS. 9 and 10, the drawer frame 12 of the printer 1 is movable in the front-to-rear direction between the mount position and the pull-out position. Provision of a single interfering member 71 in between the two positions, the process cartridge 13 disposed in the first position can be brought into abutment with the interfering member 71*b* without fail. In this way, all of the process cartridges 13 can be accurately shifted to the second position with such a simple structure. In addition, the developing roller 17 can be brought into contact with the photosensitive drum 16.

While referring to FIG. 11, a first modification of the above-described embodiment will be described. In the following description relating to the first modification, the same reference numerals used in the description of the embodiment will also be used in the description of the first modification to denote the same components, and the duplicated description thereof will be omitted.

In the above-described embodiment, the engagement member 53 is formed within the engagement member accommodating groove 54. The engagement member 53 extends continuously from the outer end of the front wall defining the engagement member accommodating groove 54 to the rear side. Also, the engagement member 53 is integrally formed with the development housing 46. However, in accordance with the first modification, as shown in FIG. 11, the engagement member 76 is provided independently of the development housing 46 and disposed within the engagement member accommodating groove 54 to be rotatable.

More specifically, the engagement member 76 is generally in the form of a plate-shape. The engagement member 76 is formed with a pair of rotational shafts 77 at the center thereof in the front-to-rear direction. The rotational shafts 77 are generally in the form of a rounded column one extending upward and the other extending downward from the respective outer edges of the engagement member 76. The center axial lines of the two rotational shafts 77 are in alignment with each other.

The engagement member 76 is rotated clockwise in the plan view in accordance with the pushing action of the engagement protrusion 55. The engagement protrusion 55 is pushed inward in the left-to-right direction by the separation release rib 62. The engagement protrusion 55 is accommodated in the engagement accommodating groove 54 due to the clockwise rotations of the engagement member 76, and disengaged from the engagement hole 37. The engagement member accommodating groove 54 has a front wall to which the stop 78 is provided. The stop 78 functions as the holding member.

The stop 78 is generally in the form of a rectangular shape as viewed from the side that projects from the vertical center of the front wall of the engagement member accommodating groove 54 toward the rear side. As shown in FIG. 11A, when the engagement projection 55 of the engagement member 76 is in engagement with the engagement hole 37, the stop 78 abuts the front end portion of the engagement member 76 from the outer side in the left-to-right direction, resulting in restricting the clockwise rotation of the engagement member 76. When the engagement projection 55 is disengaged from the engagement hole 37, the stop 78 is brought into abutment with the front end portion of the engagement member 76 from the inner side in the left-to-rear direction, restricting the counterclockwise rotation of the engagement member 76. At the time of shipping the printer 1, the stop 78 holds the front end portion of the engagement member 76 so as not to rotate.

Operational advantages as obtained in the above-described embodiment can also be obtained in the first modification.

While referring to FIG. 12, a second modification will be described. In the following description, the same reference numerals used in the description of the embodiment and/or the first modification will also be used in the description of the second modification to denote the same or corresponding components, and the duplicated description thereof will be omitted.

In the above-described embodiment, the engagement member 53 is provided in the developing unit 15, and the guide groove 34 with the engagement hole 37 is formed in the drum unit 14. Insertion of the engagement member 53 into the engagement hole 37 holds the developing unit 15 and the drum unit 14 to be fixedly disposed.

Figure 12A:
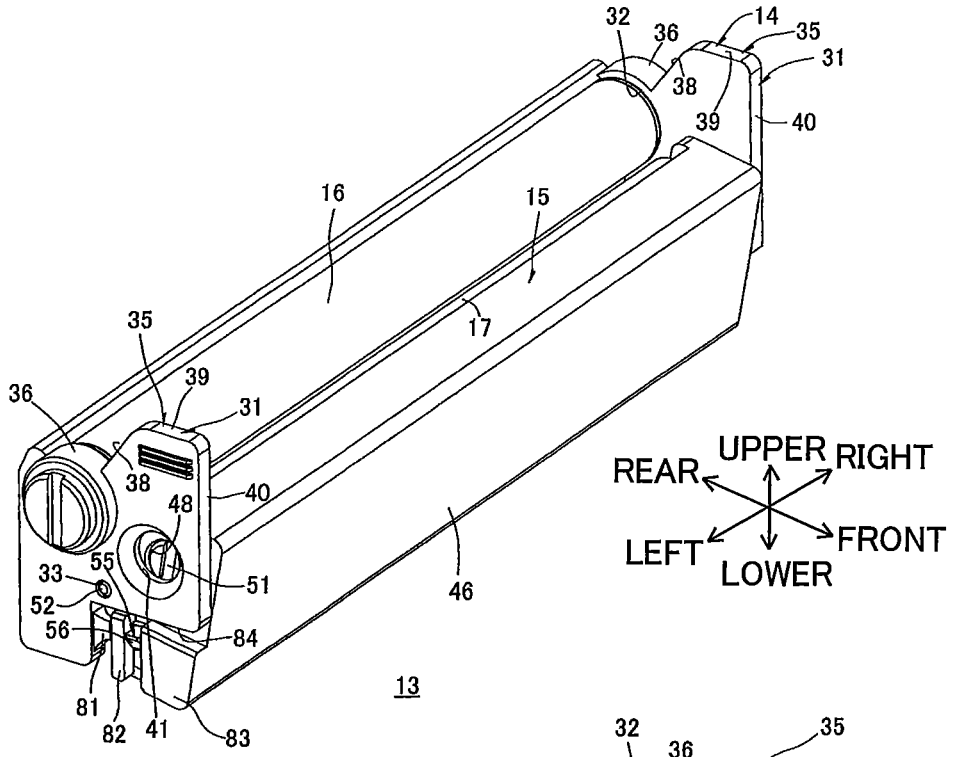
FIG. 12A is a perspective view, as viewed from left-front side, showing a process cartridge in accordance with a second modification of the embodiment, in which the drum unit and the developing unit are disposed in spaced apart.
Figure 12B:
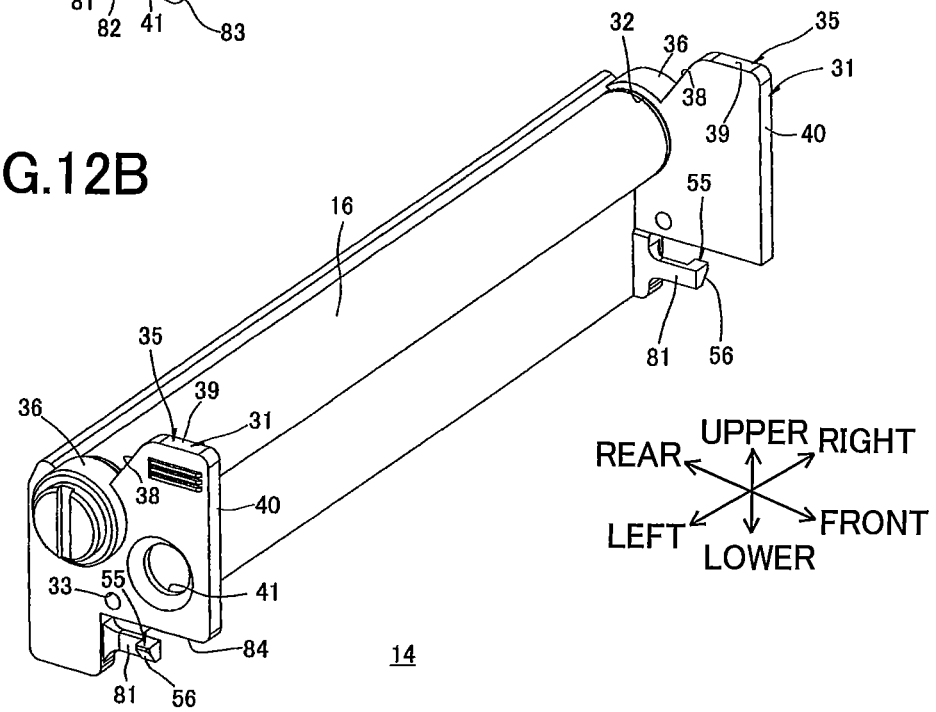
FIG. 12B is a perspective view, as viewed from left-front side, showing a process cartridge in accordance with a second modification of the embodiment, in which the drum unit and the developing unit are disposed in contact with each other.

As shown in FIG. 12, in accordance with the second modification, a first holding member 81 functioning as the separation member is provided in the drum unit 14, and a second holding member 82 functioning as a holding portion is formed in the developing unit 15.

More specifically, the supporting plate 31 of the drum unit 14 is formed with a cut-away portion 84. The cut-way portion 84 is generally rectangular as viewed from the side and is formed in the lower end and front half of the supporting plate 31. The cut-away portion 84 has a rear wall from which an elongated plate-like member functioning as the first holding member 81 extends frontward. The first holding member 81 is a resiliently deformable material, such as resin, and is formed integrally with the supporting plate 31. The first holding member 81 has a front tip end formed with an engagement projection 55 similar to the corresponding component in the above-described embodiment.

The development housing 46 of the developing unit 15 is provided with a second holding member 82 and the guide wall 83. The second holding member 82 is formed in the lower portion of the development housing 46 and is generally an L-shape extending outward in the left-to-right direction from the outer side surface of the development housing 46 and bent downward.

The guide wall 83 is provided in front of the second holding member 82. The guide wall 83 and the engaging projection 55 are spaced apart by a distance equal to or slightly longer than the front-to-rear length of the engaging projection 55. The guide wall 83 is generally rectangular as viewed from the side and protrudes outward in the left-to-right direction from the development housing 46.

The engaging projection 55 of the first holding member 81 is brought into engagement from the inner side into a gap between the second holding member 82 and the guide wall 83, thereby maintaining the drum unit 14 and the developing unit 15 in a separated condition. Further, the space between the second holding member 82 and the guide wall 83 serves as a groove for bringing the separation release rib 62 and the engaging projection 55 into abutment with each other. The first holding member 82 has a front end portion that is resiliently deformed inward in the left-to-right direction by the engaging protrusion 55 urged inward in the left-to-right direction by the separation release rib 62. The resilient deformation of the first holding member 82 causes the engaging protrusion 55 to be unrestricted by the gap between the second holding member 82 and the guide wall 83. As a result, the drum unit 14 and the developing unit 15 are no longer restricted to the separated condition.

Advantageous as obtained in the above-described embodiment are also obtainable in the second modification.

While the invention has been described in detail with reference to the embodiment thereof, it would be apparent to those skilled in the art that various changes and modifications may be made therein without departing from the spirit of the invention.

What is claimed is:

1. An image forming apparatus comprising:

a housing;

a cartridge having a first frame configured to support a photosensitive member, a second frame configured to support a developer carrying member carrying developer thereon to supply the developer onto the photosensitive member, the first frame and the second frame being engaged so as to move relative to each other between a contact position where the developer carrying member and the photosensitive member are in contact with each other and a separated position where the developer carrying member is separated from the photosensitive member, and a separation retaining member configured to retain the first frame and the second frame in the separated position;

a supporting member configured to support the cartridge to be movable between a first position where image formation with the developer is disabled and a second position where image formation with the developer is enabled, the supporting member being movable between a mount position in the housing and a pull-out position outside the housing; and a separation releasing mechanism configured to move the cartridge from the first position to the second position and disable the separation retaining member attendant to movements of the supporting member from the pull-out position to the mount position, wherein the separation releasing mechanism comprises:

an interfering member provided within the housing and configured to interfere the cartridge to move from the first position to the second position attendant to the movements of the supporting member from the pull-out position to the mount position;

a position restricting portion restricting the cartridge to be in the first position; and a separated condition releasing portion configured to allow the second frame to move to a position where the developer carrying member and the photosensitive member are in contact with each other when the cartridge moves from the first position to the second position, wherein the separation retaining member is provided in a selected one of the first frame and the second frame, a non-selected one of the first frame and the second frame is formed with an engagement portion with which the separation retaining member engages when the first frame and the second frame are in the separated position, wherein the supporting member includes a pair of side plates disposed in confrontation with each other, the cartridge having a longitudinal axis being supported between the pair of side plates in an orientation in which the longitudinal axis is in coincidence with a direction in which the pair of side plates confronts, wherein the separated condition releasing portion projects inward from each of the pair of the side plate and extends in a direction from the first position to the second position, and wherein the separation retaining member is provided in an outer end portion in the longitudinal axis of the cartridge and disengaged from the engagement portion upon abutment of the separated condition releasing portion with the separation retaining member.

2. The image forming apparatus according to claim 1, wherein the cartridge is detachably supported on the supporting member, the cartridge being moved along a direction from the first position to the second position for bringing the cartridge onto the supporting member to be supported thereon.

3. The image forming apparatus according to claim 1, wherein the position restricting portion is integrally provided in the separated condition releasing portion in a position nearer to the first position than the second position in a direction from the first position to the second position, and restricts the cartridge to be positioned in the first position by abutment of the separation retaining member with the position restricting portion.

4. The image forming apparatus according to claim 3, wherein:

the position restricting portion has a first slanted surface facing diagonally upward;

the separation retaining member has an engagement projection projecting outward in the direction from the first position to the second position; and the engagement projection has a second slanted surface with which the first slanted surface is configured to abut.

5. The image forming apparatus according to claim 4, wherein:

one of the first frame and the second frame is formed with an engagement portion with which the separation retaining member engages when the first frame and the second frame are in the separated position;

the engagement portion is a groove extending in the direction from the first position to the second position;

the engagement projection is engaged within the groove to thereby positionally fix the separated retaining member to the engagement portion; and the position restricting portion is engaged within the groove and guided relative to the engagement projection.

6. The image forming apparatus according to claim 4, wherein the separation retaining member is made from a resilient material; and the separated condition releasing portion resiliently deforms the separation retaining member against resiliency of the separation retaining member and moves the engagement projection inward in a direction in which a longitudinal axis of the cartridge extends.

7. The image forming apparatus according to claim 1, wherein the cartridge has an urging member for urging the second frame toward the first frame to bring the developer carrying member into contact with the photosensitive member.

8. The image forming apparatus according to claim 1, wherein the cartridge has a holding member for holding the separation retaining member such that a condition in which retaining the first frame and the second frame in the separated position is released is maintained.

9. The image forming apparatus according to claim 1, wherein a plurality of cartridges is arranged in parallel with one another with a spacing between adjacent two cartridges in a direction in which a longitudinal axis of each of the plurality of cartridges is orthogonal to a direction from the mount position to the pull-out position.

10. The image forming apparatus according to claim 9, wherein the supporting member is movable in a direction in which the plurality of cartridges is arranged.

11. An image forming apparatus comprising:

a housing;

a cartridge having a first frame configured to support a photosensitive member, a second frame configured to support a developer carrying member carrying developer thereon to supply the developer onto the photosensitive member, the first frame and the second frame being engaged so as to move relative to each other between a contact position where the developer carrying member and the photosensitive member are in contact with each other and a separated position where the developer carrying member is separated from the photosensitive member, and a separation retaining member configured to retain the first frame and the second frame in the separated position;

a supporting member configured to support the cartridge to be movable between a first position where image formation with the developer is disabled and a second position where image formation with the developer is enabled, the supporting member being movable between a mount position in the housing and a pull-out position outside the housing; and a separation releasing mechanism configured to move the cartridge from the first position to the second position and allow the first frame and the second frame to move from the separated position to the contact position when the cartridge is moved from the first position to the second position attendant to movements of the supporting member from the pull-out position to the mount position, wherein the separation releasing mechanism comprises:

an interfering member provided within the housing and configured to interfere the cartridge to move from the first position to the second position attendant to the movements of the supporting member from the pull-out position to the mount position;

a position restricting portion restricting the cartridge to be in the first position; and a separated condition releasing portion configured to allow the second frame to move to a position where the developer carrying member and the photosensitive member are in contact with each other when the cartridge moves from the first position to the second position, wherein the separation retaining member is provided in a selected one of the first frame and the second frame, a non-selected one of the first frame and the second frame is formed with an engagement portion with which the separation retaining member engages when the first frame and the second frame are in the separated position, wherein the supporting member includes a pair of side plates disposed in confrontation with each other, the cartridge having a longitudinal axis being supported between the pair of side plates in an orientation in which the longitudinal axis is in coincidence with a direction in which the pair of side plates confronts, wherein the separated condition releasing portion projects inward from each of the pair of the side plate and extends in a direction from the first position to the second position, and wherein the separation retaining member is provided in an outer end portion in the longitudinal axis of the cartridge and disengaged from the engagement portion upon abutment of the separated condition releasing portion with the separation retaining member.

* * * * *